US010511094B2

(12) United States Patent
Yun et al.

(10) Patent No.: US 10,511,094 B2
(45) Date of Patent: Dec. 17, 2019

(54) ANTENNA ASSEMBLY FOR A COMMUNICATION SYSTEM

(71) Applicant: TE CONNECTIVITY CORPORATION, Berwyn, PA (US)

(72) Inventors: Xing Yun, Harrisburg, PA (US); Nicholas Lee Evans, Harrisburg, PA (US); Bruce Foster Bishop, Aptos, CA (US); John Wesley Hall, Harrisburg, PA (US)

(73) Assignee: TE Connectivity Corporation, Berwyn, PA (US)

( * ) Notice: Subject to any disclaimer, the term of this patent is extended or adjusted under 35 U.S.C. 154(b) by 0 days.

(21) Appl. No.: 15/927,132

(22) Filed: Mar. 21, 2018

(65) Prior Publication Data

US 2019/0296437 A1 Sep. 26, 2019

(51) Int. Cl.

| | |
|---|---|
| ***H01Q 5/45*** | (2015.01) |
| ***H01Q 9/22*** | (2006.01) |
| ***H01Q 5/49*** | (2015.01) |
| *H01Q 1/12* | (2006.01) |

(52) U.S. Cl.

CPC ..... *H01Q 5/45* (2015.01); *H01Q 5/49* (2015.01); *H01Q 9/22* (2013.01); *H01Q 1/1207* (2013.01)

(58) Field of Classification Search

CPC .. H01Q 5/45; H01Q 5/49; H01Q 9/22; H01Q 1/12

USPC ..... 343/756

See application file for complete search history.

(56) References Cited

U.S. PATENT DOCUMENTS 6,621,464 B1 * 9/2003 Fang ..... H01O 9/28 343/793
2001/0022559 A1 * 9/2001 Takahashi ..... H01O 1/3291 343/724
2004/0222936 A1 * 11/2004 Hung ..... H01O 1/38 343/795

FOREIGN PATENT DOCUMENTS

CN 206250379 U 6/2017

OTHER PUBLICATIONS

International Search Report, International Application No. PCT/IB2019/051739, International Filing Date, Mar. 4, 2019.

* cited by examiner

*Primary Examiner* — Andrea Lindgren Baltzell

(57) ABSTRACT

A communication system includes an antenna assembly and a housing holding the antenna assembly. The antenna assembly has an antenna element having a substrate and a dual dipole antenna circuit including a low-band ground terminal, a low-band feed terminal, a high-band ground terminal and a high-band feed terminal and a transmission line electrically connected to the dual dipole antenna circuit. The housing includes an upper shell and a lower shell meeting at an interface having upper and lower strain relief components at the interface to receive the transmission line. The upper shell has an upper locating feature and the lower shell has a lower locating feature interfacing to locate the upper shell relative to the lower shell.

20 Claims, 4 Drawing Sheets

ANTENNA ASSEMBLY FOR A COMMUNICATION SYSTEM

BACKGROUND

The subject matter relates generally to an antenna assembly for a communication system.

Antennas are increasingly requested and used for a number of applications within a variety of industries. Examples of such applications include mobile phones, wearable devices, portable computers, and communication systems for vehicles (e.g., automobiles, trains, planes, etc.). But there have been conflicting market demands for such antennas. Users and vendors request multi-band capabilities but would like the antennas to be smaller, hidden, and/or positioned at non-ideal locations, such as near other metal objects.

Some antennas are contained within a housing. Mounting the antenna in the housing may be difficult. Additionally, the shape of the housing and the position of the antenna in the housing may affect antenna characteristics of the antenna. Additionally, the location and routing of the cable within the system may affect the antenna characteristics of the antenna.

Accordingly, there is a need for a communication system that includes an antenna assembly having sufficient bandwidth during operation.

BRIEF DESCRIPTION

In an embodiment, a communication system is provided including an antenna assembly and a housing holding the antenna assembly. The antenna assembly has an antenna element and a transmission line terminated to the antenna element. The antenna element has a substrate and a dual dipole antenna circuit including a low-band ground terminal, a low-band feed terminal, a high-band ground terminal and a high-band feed terminal. The transmission line has at least one feed line electrically connected to the dual dipole antenna circuit and at least one ground line electrically connected to the dual dipole antenna circuit. The housing includes an upper shell and a lower shell meeting at an interface. The upper shell has an inner end at the interface and the lower shell having an inner end at the interface. The upper shell includes an upper strain relief component at the inner end of the upper shell. The lower shell includes a lower strain relief component at the inner end of the lower shell aligned with the upper strain relief to receive the transmission line. The upper shell has an upper locating feature and the lower shell has a lower locating feature interfacing to locate the upper shell relative to the lower shell.

In an embodiment, a communication system is provided including an antenna assembly and a housing having a cavity receiving the antenna assembly. The antenna assembly has an antenna element and a transmission line. The antenna element has a substrate and a dual dipole antenna circuit electrically coupled to the transmission line. The substrate extends between a top end and a bottom end, a first side and a second side between the top end and the bottom end, and a first surface and a second surface. The dual dipole antenna circuit is provided at least on the first surface. The transmission line is terminated to the antenna element at the first surface. The housing includes an upper shell having a top wall and a lower shell having a bottom wall. The upper shell has side walls and end walls extending between the top wall and an inner end opposite the top wall. The lower shell has side walls and end walls extending between the bottom wall and an inner end opposite the bottom wall. The inner end of the upper shell meets the inner end of the lower shell at an interface. The upper shell includes an upper strain relief component on the first side at the inner end and the lower shell including a lower strain relief component on the first side at the inner end aligned with the upper strain relief to define a channel receiving the transmission line. The upper shell has an upper mounting lug on the top wall engaging and holding the top end of the substrate. The lower shell has a lower mounting lug on the bottom wall engaging and holding the bottom end of the substrate. The upper and lower mounting lugs are offset from the upper and lower strain reliefs to align the first surface with the channel.

In an embodiment, a communication system is provided including an antenna assembly and a housing holding the antenna assembly. The antenna assembly has an antenna element and a transmission line. The antenna element has a substrate and a dual dipole antenna circuit electrically coupled to the transmission line. The substrate extends between a top end and a bottom end, a first side and a second side between the top end and the bottom end, and a first surface and a second surface. The dual dipole antenna circuit is provided at least on the first surface. The dual dipole antenna includes a low-band ground terminal, a low-band feed terminal, a high-band ground terminal and a high-band feed terminal. The low-band feed terminal is asymmetric with respect to the low-band ground terminal and the high-band feed terminal is asymmetric with respect to the high-band ground terminal. The transmission line has at least one feed line electrically connected to the dual dipole antenna circuit at the first surface and at least one ground line electrically connected to the dual dipole antenna circuit at the first surface. The housing includes an upper shell and a lower shell meeting at an interface. The upper shell has an inner end at the interface and the lower shell having an inner end at the interface. The upper shell includes an upper strain relief component at the inner end of the upper shell and the lower shell includes a lower strain relief component at the inner end of the lower shell aligned with the upper strain relief to define a channel receiving the transmission line. The transmission line is routed between the substrate and the channel such that the transmission line interior of the housing is positioned generally equidistant from the low-band feed terminal and the low-band ground terminal and is generally equidistant from the high-band feed terminal and the high-band ground terminal. The transmission line is routed exterior of the housing such that the transmission line exterior of the housing is positioned closer to the low-band ground terminal than the low-band feed terminal and such that the transmission line is positioned closer to the high-band ground terminal than the high-band feed terminal.

DETAILED DESCRIPTION

Embodiments set forth herein include an antenna assembly for a communication system. In some embodiments, the antenna assembly may be part of a larger system. For example, the antenna assembly may be part of a telematics unit positioned within, for example, a vehicle (e.g., automotive). It is contemplated, however, that embodiments set forth herein may be used in other applications.

Embodiments set forth herein include an antenna assembly having an antenna element electrically connected to a transmission line. Various embodiments of the antenna element described herein include a multi-band antenna circuit. For example, various embodiments described herein include an antenna circuit operable in a low frequency band and a high frequency band. Various embodiments may include a dual dipole antenna circuit. The dual dipole antenna circuit may be operable in different frequency bands, such as in different Wi-Fi frequency bands. For example, in various embodiments described herein include an antenna circuit operable in a 2.4 GHz Wi-Fi frequency band and in a 5 GHz Wi-Fi frequency band. The antenna element may have a wide bandwidth. Various embodiments described herein have an antenna element arranged for omnidirectional performance. For example, the antenna element is arranged in a housing for omnidirectional performance. For example, the antenna element may be arranged vertically within the housing.

Embodiments may communicate within one or more radio-frequency (RF) bands. For purposes of the present disclosure, the term "RF" is used broadly to include a wide range of electromagnetic transmission frequencies including, for instance, those falling within the radio frequency, microwave, or millimeter wave frequency ranges. An RF band may also be referred to as a frequency band. An antenna assembly may communicate through one or more RF bands (or frequency bands). In particular embodiments, the antenna assembly communicates through multiple frequency bands. For example, in some embodiments, the antenna assembly may have one or more center frequencies within the 2.4 GHz spectrum band, the antenna assembly may have one or more center frequencies within the 5 GHz spectrum band, or may have one or more center frequencies within a different RF spectrum band. It should be understood that antenna assemblies described herein are not limited to particular wireless technologies (e.g., LTE, WLAN, Wi-Fi, WiMax) and other wireless technologies may be used.

Figure 1:
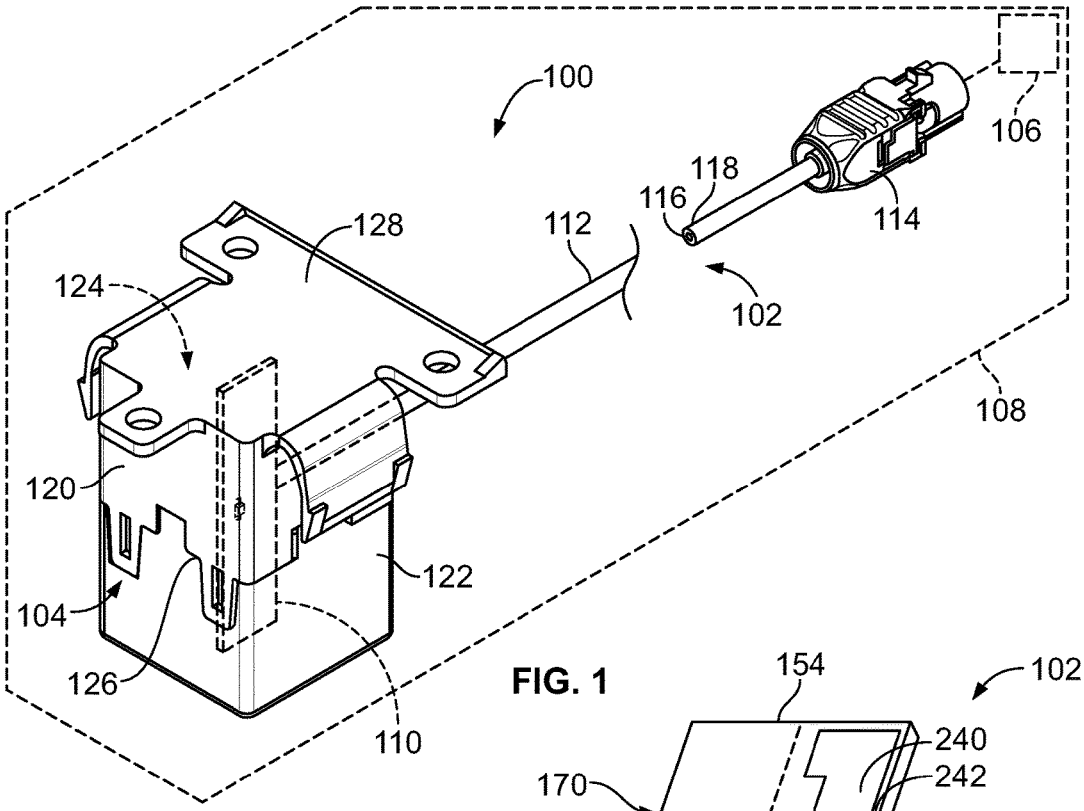
FIG. 1 is a perspective view of a communication system formed in accordance with an embodiment.

FIG. 1 is a perspective view of a communication system 100 formed in accordance with an embodiment. In an exemplary embodiment, the communication system 100 forms part of a larger system, such as a computer (e.g., desktop or portable), mobile phone, or a vehicle (e.g., automobiles, trains, planes). The communication system 100 includes an antenna assembly 102 and a housing 104 holding the antenna assembly 102.

The communication system 100 may be part of a mobile phone, a tablet, a notebook computer, a laptop computer, a desktop computer, a handset, a PDA, a wireless access point (AP) such as a Wi-Fi router, a Wi-Fi modem, a base station in a wireless network, a wireless communication USB dongle or card (e.g., PCI Express card or PCMCIA card) for a computer, or another type of wireless device. The antenna assembly 102 allows for wireless communication to and/or from the communication system 100. In certain embodiments, the communication system 100 is or forms part of a telematics unit 106 positioned within a vehicle 108, such as an automotive vehicle.

Although not shown, the communication system 100 may include system circuitry having a module (e.g., transmitter/receiver) that decodes the signals received from the antenna assembly 102 and/or transmitted by the antenna assembly 102. In other embodiments, however, the module may be a receiver that is configured for receiving only. The system circuitry may also include one or more processors (e.g., central processing units (CPUs), microcontrollers, field programmable arrays, or other logic-based devices), one or more memories (e.g., volatile and/or non-volatile memory), and one or more data storage devices (e.g., removable storage device or non-removable storage devices, such as hard drives). The system circuitry may also include a wireless control unit (e.g., mobile broadband modem) that enables the communication system 100 to communicate via a wireless network. The communication system 100 may be configured to communicate according to one or more communication standards or protocols (e.g., LTE, Wi-Fi, Bluetooth, cellular standards, etc.).

During operation of the communication system 100, the communication system 100 may communicate through the antenna assembly 102. To this end, the antenna assembly 102 may include conductive elements that are configured to exhibit electromagnetic properties that are tailored for desired applications. For instance, the antenna assembly 102 may be configured to operate in multiple RF bands simultaneously. The structure of the antenna assembly 102 can be configured to effectively operate in particular RF bands. The structure of the antenna assembly 102 can be configured to select specific RF bands for different networks. The antenna assembly 102 may be configured to have designated performance properties, such as a voltage standing wave ratio (VSWR), gain, bandwidth, and a radiation pattern.

The structure of the antenna assembly 102 can be structured and engineered to exhibit electromagnetic properties that are tailored for specific applications and can be used in applications where the antennas operate in multiple frequency bands simultaneously. The structure of the antenna assembly 102 can be structured and engineered to effectively operate in specific radio bands. The structure of the antenna assembly 102 can be structured and engineered to remotely select specific radio bands for different networks. The structure of the antenna assembly 102 can be structured and engineered to have a small physical antenna size while effectively operating in a broad frequency bandwidth. The structure of the antenna assembly 102 can be structured and engineered to dynamically tune the antenna within one or more frequency bands.

The antenna assembly 102 may include a particular arrangement of conductive elements, such as conductive elements formed by one or more circuits on a circuit board. The size, shape, and positioning of the conductive elements are designed for a particular application and may be changed to provide different characteristic for the antenna assembly 102, such as being designed to operate at different frequencies. The different conductive elements allow the antenna assembly 102 to be used in different frequency bands. The antenna assembly 102 has a wide bandwidth by use of multiple conductive elements. The antenna assembly 102 may use right hand mode elements and/or left hand mode elements having different electromagnetic modes of propagation to operate efficiently at various frequency bands.

In an exemplary embodiment, the antenna assembly 102 includes an antenna element 110 (shown in phantom) and a transmission line 112 terminated to the antenna element 110. The transmission line 112 may be a cable, such as a coaxial cable routed from the housing 104 to another component, such as the telematics unit 106. In an exemplary embodiment, a connector 114 is provided at the end of the transmission line 112, such as for coupling to the telematics unit 106. In an exemplary embodiment, the transmission line 112 includes at least one feed line 116 and at least one ground line 118. The feed line 116 and the ground line 118 are configured to be electrically connected to the antenna element 110. In the illustrated embodiment, the feed line 116 is a center conductor of the coaxial cable and the ground line 118 is a ground shield of the coaxial cable; however, other types of transmission lines 112 may be provided in alternative embodiments.

The housing 104 holds the antenna element 110. In an exemplary embodiment, the housing 104 holds the antenna element 110 in a vertical orientation; however, other orientations are possible in alternative embodiments. In an exemplary embodiment, the housing 104 is a multi-piece housing, such as including an upper shell 120 and a lower shell 122. The upper shell 120 and the lower shell 122 define a cavity 124 that receives the antenna element 110. The transmission line 112 extends into the cavity 124 for electrical connection with the antenna element 110. The transmission line 112 extends to an exterior of the housing 104 and is routed away from the housing 104. The upper shell 120 and the lower shell 122 meet at an interface 126. In an exemplary embodiment, the transmission line 112 extends from the housing 104 at the interface 126. For example, the transmission line 112 may be sandwiched between the upper shell 120 and the lower shell 122 at the interface 126.

In an exemplary embodiment, the housing 104 includes a mounting element 128 for mounting the housing 104 to another structure or component. In the illustrated embodiment, the mounting element 128 includes mounting flanges extending from the housing 104, such as at the top of the housing 104. The mounting element 128 may include openings for receiving a fastener or other component used to secure the housing 104 to the other component. The mounting element 128 may include one or more latches for latchably securing the housing 104 to another component. The mounting element 128 is used to orient the housing 104 within the environment, such as within the vehicle 108. For example, the mounting element 128 may hold the housing 104 in an upright position to hold the antenna element 110 in the vertical, or other, orientation.

Figure 2:
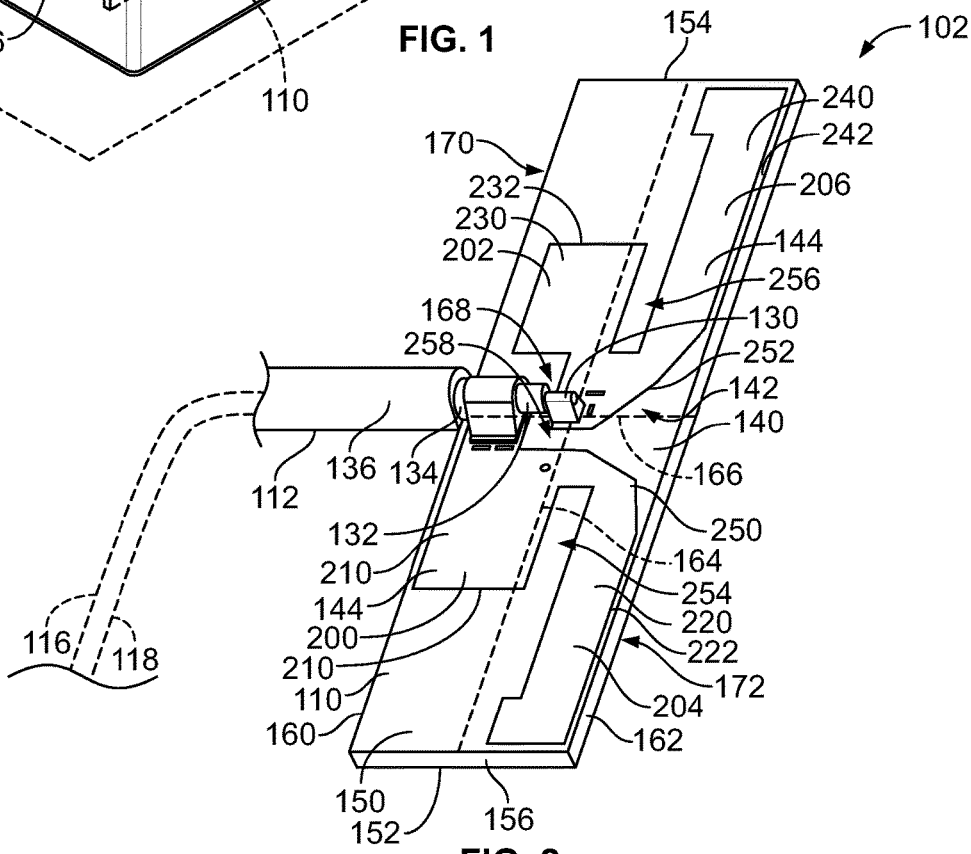
FIG. 2 is a perspective view of a portion of an antenna assembly of the communication system in accordance with an exemplary embodiment.
Figure 3:
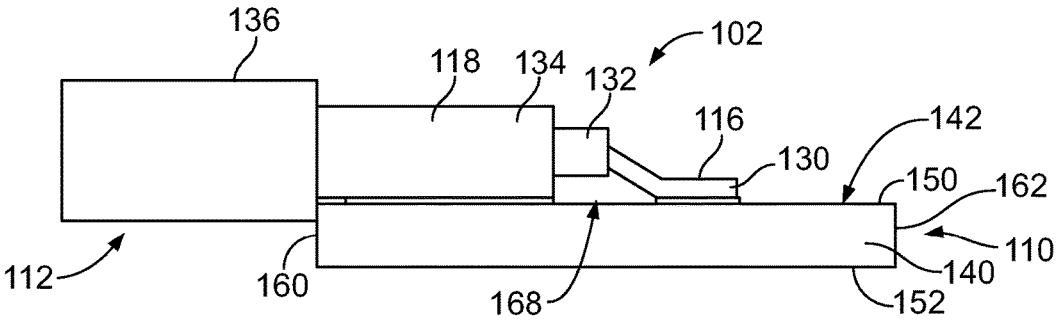
FIG. 3 is a side view of a portion of the antenna assembly in accordance with an exemplary embodiment.

FIG. 2 is a perspective view of a portion of the antenna assembly 102 in accordance with an exemplary embodiment showing the antenna element 110 and a portion of the transmission line 112. FIG. 3 is a side view of a portion of the antenna assembly 102 in accordance with an exemplary embodiment showing the antenna element 110 and a portion of the transmission line 112. The transmission line 112, in the illustrated embodiment, is a coaxial cable having a center conductor 130, an insulator 132, a ground shield 134 and an outer jacket 136. The center conductor 130 defines the feed line 116 and the ground shield 134 defines the ground line 118. The center conductor 130 may be soldered to, or otherwise electrically connected to, the antenna element 110. The outer jacket 136 may be soldered to, or otherwise electrically connected to, the antenna element 110.

The antenna element 110 includes a substrate 140 and one or more antenna circuits 142 on the substrate 140. In an exemplary embodiment, the antenna circuit 142 is a dual dipole antenna circuit; however, other types of antenna circuits may be used in alternative embodiments. The antenna circuit 142 is defined by conductive elements 144 on the substrate 140. The conductive elements 144 may be pads, traces, vias and the like on one or more layers of the substrate 140. In an exemplary embodiment, the substrate 140 is a circuit board and the antenna circuit 142 is defined by the conductive elements 144 being printed on one or more layers of the circuit board.

The substrate 140 includes a first surface 150 and a second surface 152 opposite the first surface 150. The surfaces 150, 152 define the main surfaces of the substrate 140. In an exemplary embodiment, the conductive elements 144 defining the antenna circuit 142 are formed on the first surface 150 and/or the second surface 152. The substrate 150 extends between a top and 154 and a bottom end 156 opposite the top end 154. The substrate 140 includes a first side 160 and a second side 162 opposite the first side 160. The top and bottom ends 154, 156 and the first and second sides 160, 162 define perimeter edges of the substrate 140 between the first and second surfaces 150, 152. The substrate 140 is rectangular in the illustrated embodiment. However, the substrate 140 may have other shapes in alternative embodiments including additional edges.

In an exemplary embodiment, the substrate 140 extends along a longitudinal axis 164 and a lateral axis 166. In the illustrated embodiment, the first and second sides 160, 162 extend parallel to the longitudinal axis 164 and the top and bottom ends 154, 156 extend parallel to the lateral axis 166. The substrate 140 has a length defined along the longitudinal axis 164 and a width defined along the lateral axis 166. For example, the sides 160, 162 define the length of the substrate 140 and the ends 154, 156 define the width of the substrate 140. In an exemplary embodiment, the antenna element 110 is oriented within the system in a vertical orientation such that the length is a vertical length.

Optionally, as in the illustrated embodiment, the transmission line 112 may be terminated to the antenna element 110 at the first surface 150 approximately centered between the top end 154 and the bottom end 156 and a mounting area 168. The substrate 140 defines an upper portion 170 between the mounting area 168 and the top end 154. The substrate 140 defines a lower portion 172 between the mounting area 168 and the bottom end 156. Optionally, the surface area of the upper portion 170 may be approximately equal to the surface area of the lower portion 172.

In an exemplary embodiment, the antenna circuit 142 is a dual dipole antenna circuit 142 having the various conductive elements 144 used to target different frequency bands. In an exemplary embodiment, the dual dipole antenna circuit 142 includes a low band ground terminal 200, a low band feed terminal 202, a high band ground terminal 204 and a high band feed terminal 206 defined by different conductive elements 144. The feed line 116 is electrically connected to the low band feed terminal 202 and the high band feed terminal 206. The ground line 118 is electrically connected to the low band ground terminal 200 and the high band ground terminal 204. The various conductive elements 144 may be directly electrically coupled together or may be capacitively coupled together. The sizes, shapes and relative positions of the conductive elements 144 controls antenna characteristics, such as operating frequencies, of the antenna circuit 142.

The low band ground terminal 200 includes a cell 210 connected to the ground line 118. The cell 210 may have any size and shape. The cell 210 is defined by a pad on the substrate 140. The size and shape of the cell 210 controls antenna characteristics of the low band ground terminal 200. The cell 210 has a length defined along the longitudinal axis 164 and a width defined along the lateral axis 166. The cell 210 is peripherally surrounded by an edge 212. The edge 212 may define a polygon. Optionally, the width and/or the length of the cell 210 may be non-uniform. In an exemplary embodiment, the cell 210 is a large circuit structure on the substrate 140 occupying approximately 10% or more of the surface area of the substrate 140.

The low band feed terminal 202 includes a cell 220 connected to the feed line 116. The cell 220 may have any size and shape. The cell 220 is defined by a pad on the substrate 140. The size and shape of the cell 220 controls antenna characteristics of the low band feed terminal 202. The cell 220 has a length defined along the longitudinal axis 164 and a width defined along the lateral axis 166. The cell 220 is peripherally surrounded by an edge 222. The edge 222 may define a polygon. Optionally, the width and/or the length of the cell 220 may be non-uniform. In an exemplary embodiment, the cell 220 is a large circuit structure on the substrate 140 occupying approximately 10% or more of the surface area of the substrate 140.

The high band ground terminal 204 includes a cell 230 connected to the ground line 118. The cell 230 may have any size and shape. The cell 230 is defined by a pad on the substrate 140. The size and shape of the cell 230 controls antenna characteristics of the high band ground terminal 204. The cell 230 has a length defined along the longitudinal axis 164 and a width defined along the lateral axis 166. The cell 230 is peripherally surrounded by an edge 232. The edge 232 may define a polygon. Optionally, the width and/or the length of the cell 230 may be non-uniform. In an exemplary embodiment, the cell 230 is a large circuit structure on the substrate 140 occupying approximately 10% or more of the surface area of the substrate 140.

The high band feed terminal 206 includes a cell 240 connected to the feed line 116. The cell 240 may have any size and shape. The cell 240 is defined by a pad on the substrate 140. The size and shape of the cell 240 controls antenna characteristics of the high band feed terminal 206. The cell 240 has a length defined along the longitudinal axis 164 and a width defined along the lateral axis 166. The cell 240 is peripherally surrounded by an edge 242. The edge 242 may define a polygon. Optionally, the width and/or the length of the cell 240 may be non-uniform. In an exemplary embodiment, the cell 240 is a large circuit structure on the substrate 140 occupying approximately 10% or more of the surface area of the substrate 140.

In an exemplary embodiment, the low band ground terminal 200 and the high band ground terminal 204 are connected by a bridge 250 between the cell 210 and the cell 230. In an exemplary embodiment, the low band feed terminal 202 and the high band feed terminal 206 are connected by a bridge 252 between the cell 220 and the cell 240. The sizes and shapes of the bridges 250, 252 control antenna characteristics of the antenna circuit 142. The sizes and shapes of the gaps 254, 256 control antenna characteristics of the antenna circuit 142. The size and shape of the gap 258 controls antenna characteristics of the antenna circuit 142.

In an exemplary embodiment, the antenna circuit 142 is asymmetric. For example, the sizes and shapes of the low band terminals 200, 202 may be different than the sizes and shapes of the corresponding high band terminals 204, 206. The sizes and shapes of the bridges 250, 252 may be asymmetrical. For example, the bridge 250 may have a different surface area than the bridge 252. The sizes and shapes of the gaps 254, 256 may be asymmetrical. In an exemplary embodiment, the low band ground terminal 200 is shorter and wider compared to the high band ground terminal 204 and the high band ground terminal 204 is longer and narrower compared to the low band ground terminal 200. The lengths and/or the widths of the ground terminals 200, 204 may affect the target frequencies of the dual dipole antenna circuit 142. In an exemplary embodiment, the low band feed terminal 202 is shorter and wider compared to the high band feed terminal 206 and the high band feed terminal 206 is longer and narrower compared to the low band feed terminal 202. The lengths and/or the widths of the feed terminals 202, 206 may affect the target frequencies of the dual dipole antenna circuit 142. In an exemplary embodiment, the low band ground terminal 200 and the high band ground terminal 204 are asymmetrical. For example, the cell 210 may have a different surface area than the cell 230. In an exemplary embodiment, the low band feed terminal 202 and the high band feed terminal 206 are asymmetrical. For example, the cell 220 may have a different surface area than the cell 240.

Optionally, the ground terminals 200, 204 may be asymmetrical relative to the feed terminals 202, 206 due to the relative locations of the terminals to the transmission line 112. For example, in an exemplary embodiment, the transmission line 112 may be routed or bent downward in use, such as exterior of the housing 104 (shown in FIG. 1), and thus is located closer to the low band ground terminal 200 and the high band ground terminal 204 then the low band feed terminal 202 and the high band feed terminal 206, which may affect the antenna characteristics of the antenna circuit 142. The sizes and shapes of the conductive elements 144 may be selected to be asymmetrical to accommodate for the position of the transmission line 112 relative to the conductive elements 144. While the transmission line 112 may be routed between the substrate 140 and the housing 104 such that the transmission line 112 interior of the housing 104 is positioned generally equidistant from the low band feed terminal 202 and the low band ground terminal 200 and is generally equidistant from the high band feed terminal 206 and the high band ground terminal 204. However, exterior of the housing 104, where the transmission line 112 may be bent to routed downward, the transmission line 112 exterior of the housing 104 may be positioned closer to the low band ground terminal 200 and the low band feed terminal 202 and may be positioned closer to the high band ground terminal 204 than the high band feed terminal 206. The asymmetrical sizes and shapes of the cells to 10, 220, 230, 240 may accommodate for the relative positions of the transmission line 112 and the conductive elements 144.

In an exemplary embodiment, the low band feed terminal 202 and the high band feed terminal 206 are located in the upper portion 170 of the substrate 140 and the low band ground terminal 200 and the high band ground terminal 204 are located in the lower portion 172 of the substrate 140. For example, the low band feed terminal 202 and the high band feed terminal 206 extend upward from the mounting area 168 and the low band ground terminal 200 and the high band ground terminal 204 extend downward from the mounting area 168. Other locations are possible in alternative embodiments.

In an exemplary embodiment, the low band ground terminal 200 is located proximate to the first side 160 of the substrate 140 and the high band ground terminal 204 is located proximate to the second side 162 of the substrate 140. In an exemplary embodiment, the low band feed terminal 202 is located proximate to the first side 160 of the substrate 140 and the high band feed terminal 206 is located proximate to the second side 162 of the substrate 140. The low band terminals 200, 202 may be located closer to the transmission line 112 for affecting the antenna characteristics of the dual dipole antenna circuit 142. Other locations are possible in alternative embodiments.

Figure 4:
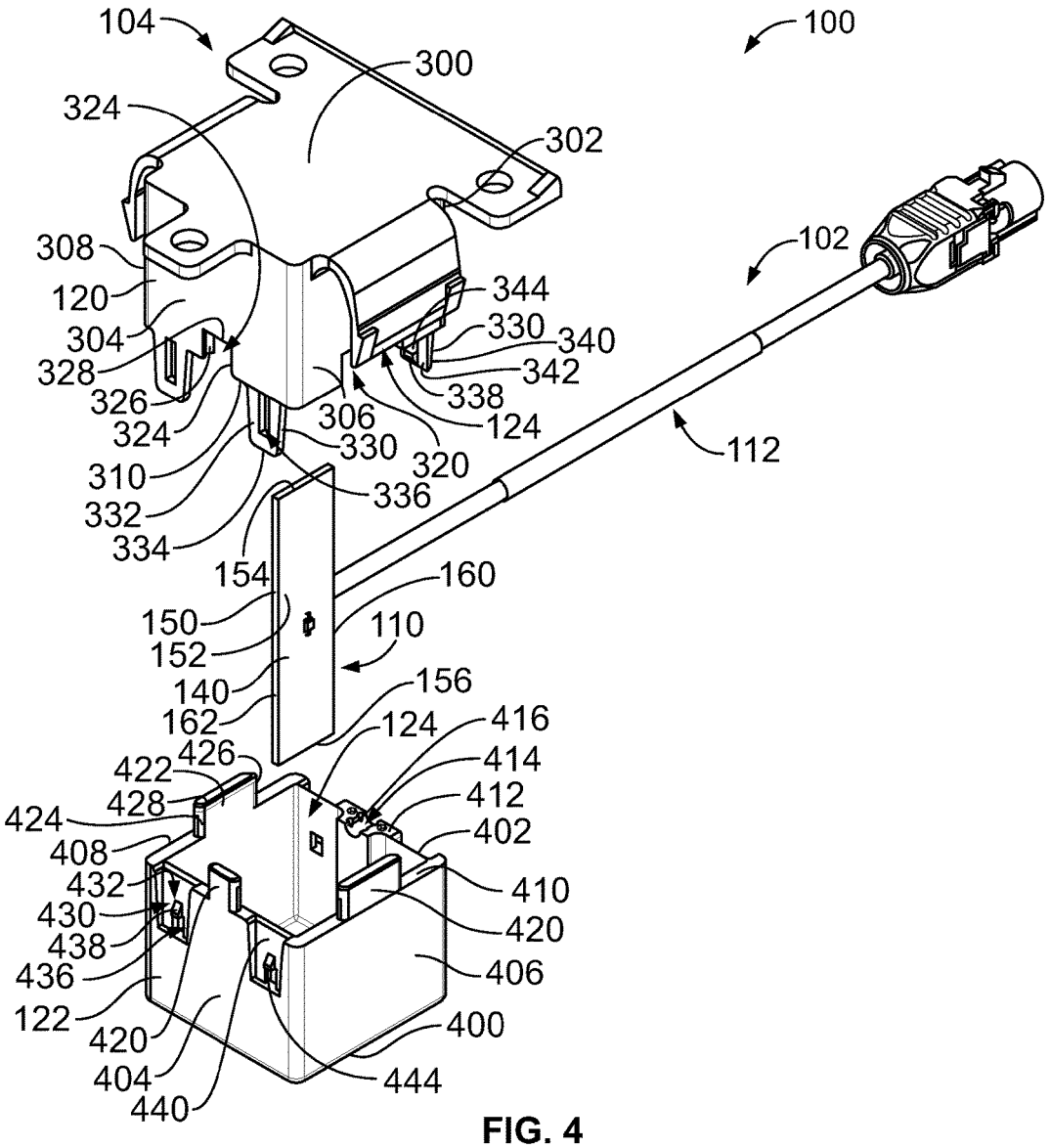
FIG. 4 is an exploded view of the communication system in accordance with an exemplary embodiment.

FIG. 4 is an exploded view of the communication system 100 in accordance with an exemplary embodiment showing the antenna assembly 102 and the housing 104. The antenna element 110 is configured to be received in the cavity 124 between the upper shell 120 and the lower shell 122. In an exemplary embodiment, the antenna element 110 is positioned vertically with the top end 154 of the substrate 140 facing the upper shell 120 and the bottom end 156 of the substrate 140 facing the lower shell 122.

The upper shell 120 includes a top wall 300, first and second side walls 302, 304 and first and second end walls 306, 308 extending between the top wall 300 and an inner end 310. The inner end 310 faces the lower shell 122 at the interface 126. In the illustrated embodiment, the mounting element 128 is provided on the upper shell 120, such as at the top wall 300. The side walls 302, 304 and the end walls 306, 308 define the cavity 124. The top wall 300 is provided above the cavity 124.

Figure 5:
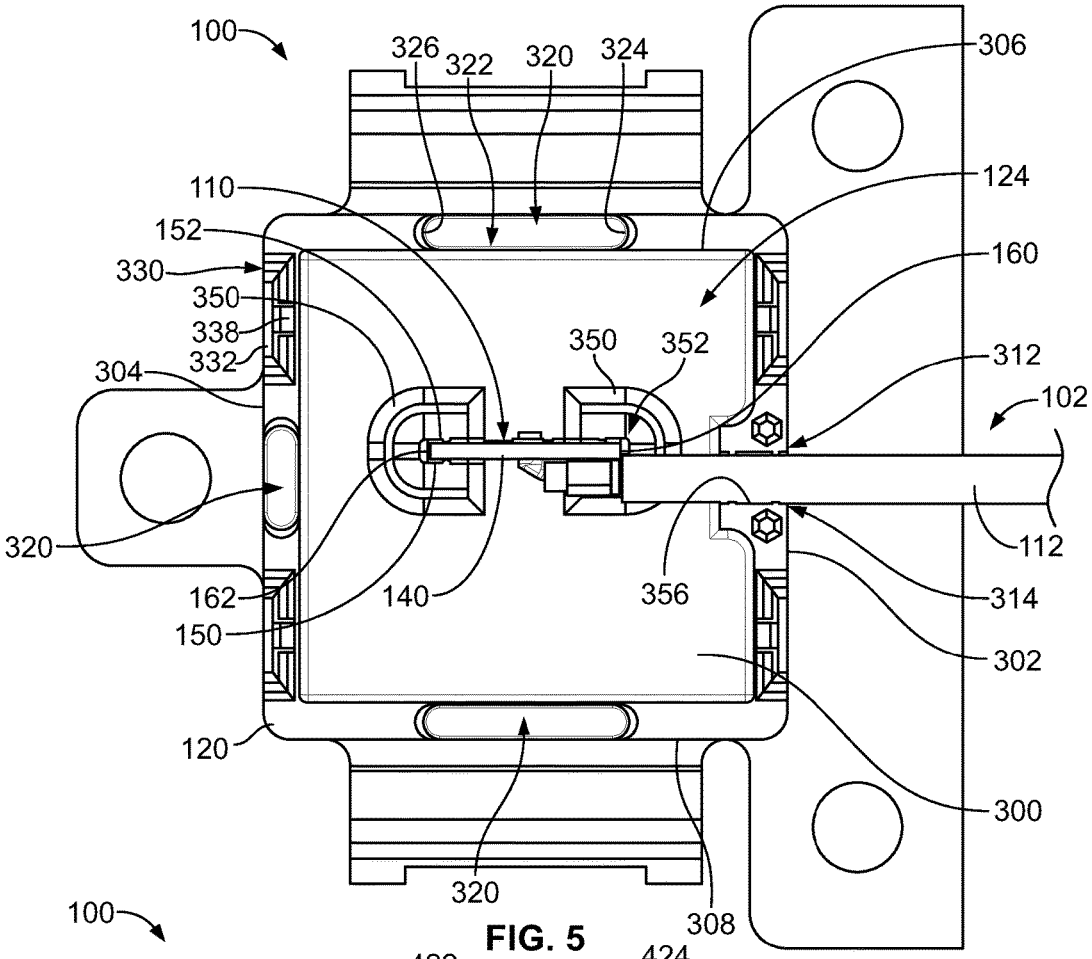
FIG. 5 is a bottom view of a portion of the communication system showing the antenna assembly in an upper shell in accordance with an exemplary embodiment.

In an exemplary embodiment, the upper shell 120 includes an upper strain relief component 312 (shown in FIG. 5). The strain relief component 312 receives the transmission line 112. Optionally, the strain relief component 312 may be provided at the first side wall 302. The strain relief component 312 is provided at the inner end 310.

In an exemplary embodiment, the upper shell 120 includes one or more upper locating features 320 configured to interface with corresponding features of the lower shell 122 to locate the upper shell 120 relative to the lower shell 122. In the illustrated embodiment, the upper locating features 320 include pockets 322 at the inner end 310. Each pocket 322 is defined by a first pocket edge 324 and a second pocket edge 326 opposite the first pocket edge 324. In the illustrated embodiment, each pocket 322 is defined by an upper edge 328 between the first and second pocket edges 324, 326. In an exemplary embodiment, the pocket edges 324, 326 have curved profiles for interfacing with portions of the lower shell 122. In the illustrated embodiment, the pocket edges 324, 326 are concave. The pocket edges 324, 326 may have other shapes in alternative embodiments, such as being angular or planar.

Any number of the upper locating features 320 may be provided. In the illustrated embodiment, the upper locating features 320 are provided on the first end wall 306, the second end wall 308 and the second side wall 304. However, the upper locating features 320 may be provided on other walls or in other locations in alternative embodiments. Having the upper locating features 320 on the end walls 306, 308 and the side wall 304 orients the upper locating features 320 in different perpendicular orientations for locating the upper shell 120 relative to the lower shell 122 in orthogonal directions (for example, laterally and longitudinally). Optionally, the upper locating features 320 may be approximately centered on the corresponding walls 304, 306, 308. The interaction of the upper locating features 320 with the lower shell 122 may resist bowing of the walls 304, 306, 308. Optionally, the upper locating features 320 may include crush ribs on the first pocket edge 324 and/or the second pocket edge 326.

In an exemplary embodiment, the upper shell 120 includes one or more upper latching features 330 configured to interface with the lower shell 122 to latchably couple the upper shell 120 to the lower shell 122. In the illustrated embodiment, the upper latching features 330 include latching straps 332 extending downward from the inner end 310. However, other types of latching features may be used in alternative embodiments, such as latching recesses that receive latching straps of the lower shell 122. In the illustrated embodiment, the upper latching features 330 are provided on the first side wall 302 and the second side wall 304. However, other locations are possible in alternative embodiments. In an exemplary embodiment, each latching straps 332 is deflectable. The latching strap 332 extends to a distal end 334. The latching strap 332 includes an opening 336, such as for receiving a latching feature of the lower shell 122.

In an exemplary embodiment, the latching straps 332 includes a ramped latch 338 configured to engage the lower shell 122 to latchably couple the upper latching feature 330 to the lower shell 122. The latching strap 332 includes an outer surface 340 and an inner surface 342. The inner surface 342 is configured to face the lower shell 122. The ramped latch 338 is provided at the bottom of the opening 336 and extends inward from the inner surface 342. In an exemplary embodiment, the latching straps 332 is wedge shaped being thinner at the distal end 334 and thicker at the inner end 310 of the upper shell 120. For example, the inner surface 342 may be angled relative to the outer surface 340. Having the latching straps 332 wedge shaped provides easier alignment and mating with the lower shell 122. The ramped latch 338 has a latching surface 344. In the illustrated embodiment, the latching surface 344 is upward facing. The ramped latch 338 extends inward from the inner surface 342 such that the latching surface 344 stands proud of the inner surface 342. The latching surface 344 provides a large surface area for interfacing with the lower shell 122 for latching the upper shell 120 to the lower shell 122.

The lower shell 122 includes a bottom wall 400, first and second side walls 402, 404 and first and second end walls 406, 408 extending between the bottom wall 400 and an inner end 410. The inner end 410 faces the upper shell 120 at the interface 126. In the illustrated embodiment, the mounting element 128 is provided on the lower shell 122, such as at the bottom wall 400. The side walls 402, 404 and the end walls 406, 408 define the cavity 124. The bottom wall 400 is provided above the cavity 124.

In an exemplary embodiment, the lower shell 122 includes a lower strain relief component 412. The strain relief component 412 receives the transmission line 112. Optionally, the strain relief component 412 may be provided at the first side wall 402. The strain relief component 412 is provided at the inner end 410. The lower strain relief component 412 forms a channel 414 with the upper strain relief component 312 that receives the transmission line 112. In an exemplary embodiment, the strain relief component 412 includes crush ribs 416 that engage the transmission line 112 and hold the transmission line 112 in an interference fit to provide strain relief on the transmission line 112 and the antenna element 110. Optionally, the channel 414 may be sealed, such as with a seal or gasket.

In an exemplary embodiment, the lower shell 122 includes one or more lower locating features 420 configured to interface with corresponding upper locating features 320 of the upper shell 120 to locate the lower shell 122 relative to the upper shell 120. In the illustrated embodiment, the lower locating features 420 include tabs 422 extending upward from the inner end 410. Each tab 422 is defined by a first tab edge 424 and a second tab edge 426 opposite the first tab edge 424. In the illustrated embodiment, each tab 422 is defined by an upper edge 428 between the first and second tab edges 424, 426. In an exemplary embodiment, the tab edges 424, 426 have curved profiles for interfacing with the first and second pocket edges 324, 326 of the upper shell 120. In the illustrated embodiment, the tab edges 424, 426 are convex and configured to protrude into the first and second pocket edges 324, 326 to lock the lower locating features 420 in the upper locating features 320. The tab edges 424, 426 may have other shapes in alternative embodiments, such as being angular or planar.

Any number of the lower locating features 420 may be provided. In the illustrated embodiment, the lower locating features 420 are provided on the first end wall 406, the second end wall 408 and the second side wall 404. However, the lower locating features 420 may be provided on other walls or in other locations in alternative embodiments. Having the lower locating features 420 on the end walls 406, 408 and the side wall 404 orients the lower locating features 420 in different perpendicular orientations for locating the lower shell 122 relative to the upper shell 120 in orthogonal directions (for example, laterally and longitudinally). Optionally, the lower locating features 420 may be approximately centered on the corresponding walls 404, 406, 408. The interaction of the lower locating features 420 with the upper locating features 320 may resist bowing of the walls 404, 406, 408. Optionally, the lower locating features 420 include crush ribs 418 on the first tab edge 424 and/or the second tab edge 426 to secure the tabs 422 to the walls 304, 306, 308 of the upper shell 120.

In an exemplary embodiment, the lower shell 122 includes one or more lower latching features 430 configured to interface with the upper latching features 330 of the upper shell 120 to latchably couple the lower shell 122 to the upper shell 120. In the illustrated embodiment, the lower latching features 430 include latching recesses 432 formed in the exterior surfaces of the lower shell 122 and extending downward from the inner end 410. However, other types of latching features may be used in alternative embodiments, such as latching straps extending upward from the inner end 410. In the illustrated embodiment, the lower latching features 430 are provided on the first side wall 402 and the second side wall 404. However, other locations are possible in alternative embodiments. The latching recess 432 includes an opening 436, such as for receiving a ramped latch 338 of the upper shell 120.

In an exemplary embodiment, the latching recess 432 includes a ramped latch 438 configured to engage the upper shell 120 to latchably couple the lower latching feature 430 to the upper shell 120. The latching recess 432 includes an outer surface 440 configured to face the inner surface 342 of the corresponding latching strap 332. The ramped latch 438 is provided at the top of the opening 436 and extends outward from the outer surface 440. In an exemplary embodiment, the latching recess 432 is wedge shaped being wider at the top and narrower at the bottom. For example, the outer surface 440 may be angled. The ramped latch 438 has a latching surface 444. In the illustrated embodiment, the latching surface 444 is downward facing. The ramped latch 438 extends outward from the outer surface 440 such that the latching surface 444 stands proud of the outer surface 440. The latching surface 444 provides a large surface area for interfacing with the ramped latch 338 of the upper shell 120 for latching the lower shell 122 to the upper shell 120.

Figure 6:
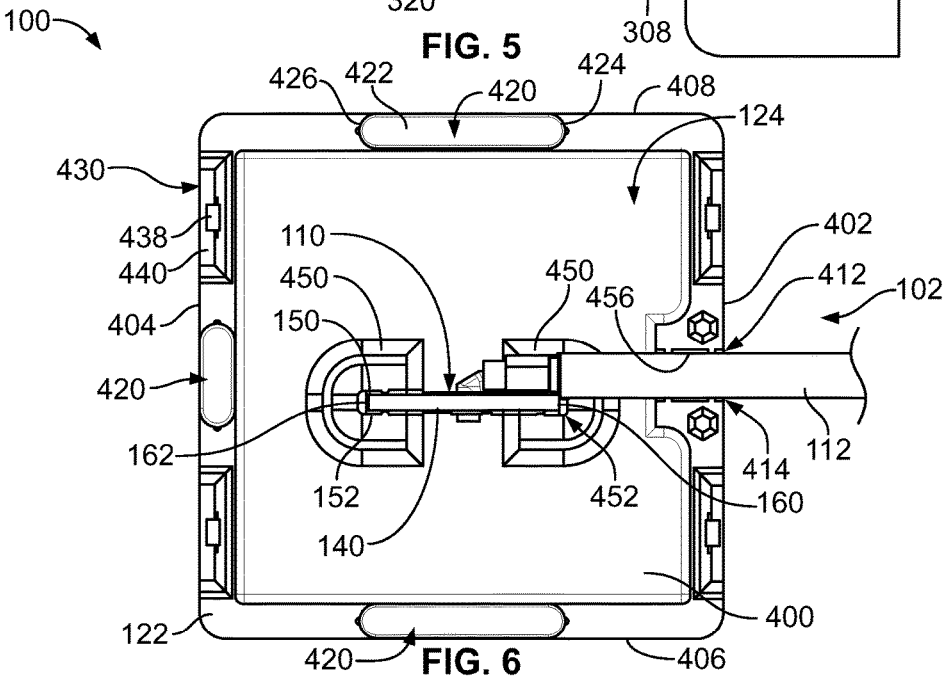
FIG. 6 is a top view of a portion of the communication system showing the antenna assembly in a lower shell in accordance with an exemplary embodiment.
Figure 7:
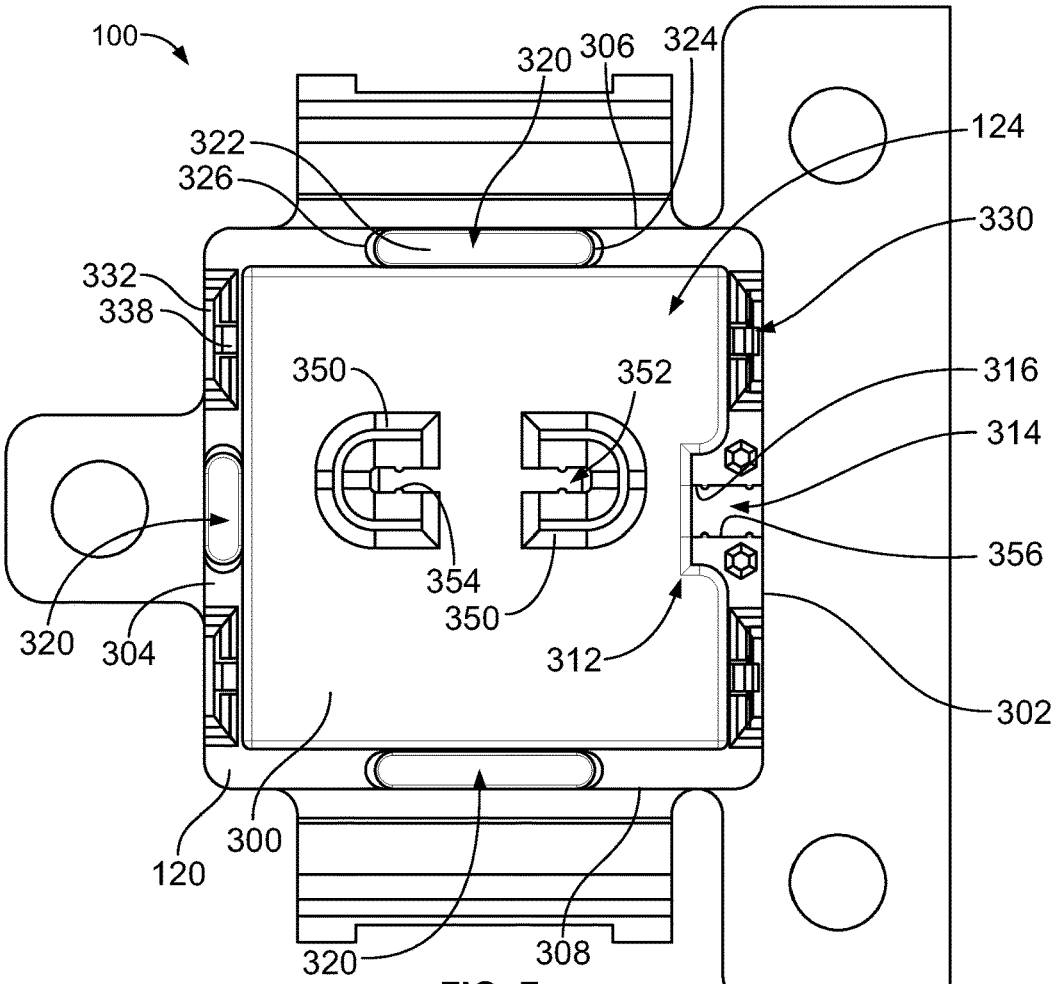
FIG. 7 is a bottom view of the upper shell in accordance with an exemplary embodiment.
Figure 8:
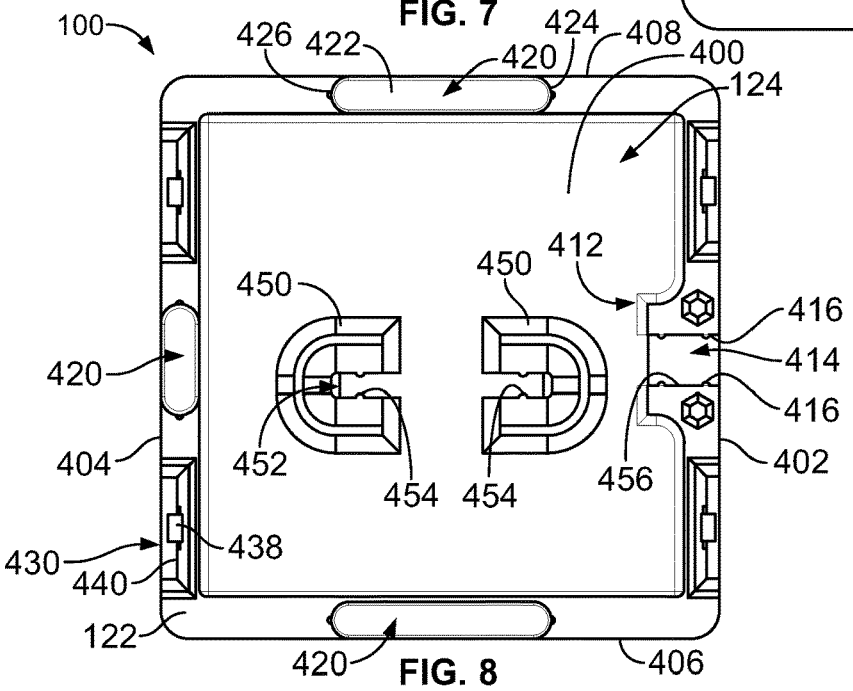
FIG. 8 is a top view of the lower shell in accordance with an exemplary embodiment.

FIG. 5 is a bottom view of a portion of the communication system 100 showing the antenna assembly 102 in the upper shell 120. FIG. 6 is a top view of a portion of the communication system 100 showing the antenna assembly 102 in the lower shell 122. FIG. 7 is a bottom view of the upper shell 120. FIG. 8 is a top view of the lower shell 122.

The upper strain relief component 312 is shown in FIGS. 5 and 7. The upper strain relief component 312 defines a channel 314 that receives the transmission line 112 (FIG. 5). The upper strain relief component 312 includes crush ribs 316 that engage and hold the transmission line 112 in the channel 314 to provide strain relief for the transmission line 112 and the antenna element 110. The transmission line 112 extends into the cavity 124 to electrically connect to the antenna element 110.

The upper locating features 320 are shown in FIGS. 5 and 7. The pocket edges 324, 326 of the pockets 322 have concave curved profiles; however, the pockets 322 may have other shapes in alternative embodiments. The upper latching features 330 are shown in FIGS. 5 and 7. The ramped latches 338 extend inward from the latching straps 332 for engaging the lower shell 122.

The lower strain relief component 412 is shown in FIGS. 6 and 8. The lower strain relief component 412 defines the channel 414 that receives the transmission line 112 (FIG. 6). The crush ribs 416 engage and hold the transmission line 112 in the channel 414 to provide strain relief for the transmission line 112 and the antenna element 110. The transmission line 112 extends into the cavity 124 to electrically connect to the antenna element 110.

The lower locating features 420 are shown in FIGS. 6 and 8. The tab edges 424, 426 of the tabs 422 have convex curved profiles; however, the tabs 422 may have other shapes in alternative embodiments. The lower latching features 430 are shown in FIGS. 6 and 8. The ramped latches 438 are provided on the outer surfaces 440 for engaging the ramped latches 338 of the latching straps 332 of the upper shell 120.

In an exemplary embodiment, the upper shell 120 includes one or more upper mounting lugs 350 on the top wall 300. The upper mounting lugs 350 engage and hold the top end 154 of the substrate 140. The upper mounting lugs 350 define a channel 352 that receives the substrate 140. In an exemplary embodiment, the upper mounting lugs 350 include crush ribs 354 extending into the channel 352 to engage and hold the substrate 140 by an interference fit. In the illustrated embodiment, the upper shell 120 includes a pair of opposed, U-shaped upper mounting lugs 350 that capture the first side 160 and the second side 162 of the substrate 140. Optionally, the upper mounting lugs 350 may be approximately centered between the first and second side walls 302, 304 of the upper shell 120, such as to center the antenna element 110 in the cavity 124 between the first and second side walls 302, 304. In various alternative embodiments, the upper shell 120 may include a single upper mounting lug 350 or may include more than two upper mounting lugs 350. The upper mounting lugs 350 may have other shapes in alternative embodiments.

In an exemplary embodiment, the upper mounting lugs 350 are relatively short compared to the side walls 302, 304 and the end walls 306, 308. As such, the upper mounting lugs 350 merely engage the top end 154 of the substrate 140 leaving a large portion of the substrate 140 uncovered by the upper mounting lugs 350. Rather, the vast majority of the substrate 140 is exposed to air in the cavity 124 to reduce interference with the conductive elements 144 defining the antenna circuit 142.

In an exemplary embodiment, the upper mounting lugs 350 are offset between the first and second end walls 306, 308. For example, the upper mounting lugs 350 are offset closer to the first end wall 306. The channel 352 is offset between the first end wall 306 and the second end wall 308 to position the substrate 140 closer to the first end wall 306 than the second end wall 308. The upper mounting lugs 350 of the substrate 140 offset from the channel 314 to allow the transmission line 112 to pass straight from the upper strain relief component 312 to the first surface 150 of the substrate 140. For example, the upper mounting lugs 350 are positioned along the top wall 300 such that the first surface 150 of the substrate 140 is aligned with an edge 356 of the channel 314. The second surface 152 of the substrate 140 is offset from the channel 314. The transmission line 112 passes straight from the first surface 150 through the upper strain relief component 312.

In an exemplary embodiment, the lower shell 122 includes one or more lower mounting lugs 450 on the bottom wall 400. The lower mounting lugs 450 engage and hold the bottom end 156 of the substrate 140. The lower mounting lugs 450 define a channel 452 that receives the substrate 140. In an exemplary embodiment, the lower mounting lugs 450 include crush ribs 454 extending into the channel 452 to engage and hold the substrate 140 by an interference fit. In the illustrated embodiment, the lower shell 122 includes a pair of opposed, U-shaped lower mounting lugs 450 that capture the first side 160 and the second side 162 of the substrate 140. Optionally, the lower mounting lugs 450 may be approximately centered between the first and second side walls 402, 404 of the lower shell 122, such as to center the antenna element 110 in the cavity 124 between the first and second side walls 402, 404. In various alternative embodiments, the lower shell 122 may include a single lower mounting lug 450 or may include more than two lower mounting lugs 450. The lower mounting lugs 450 may have other shapes in alternative embodiments.

In an exemplary embodiment, the lower mounting lugs 450 are relatively short compared to the side walls 402, 404 and the end walls 406, 408. As such, the lower mounting lugs 450 merely engage the bottom end 156 of the substrate 140 leaving a large portion of the substrate 140 uncovered by the lower mounting lugs 450. Rather, the vast majority of the substrate 140 is exposed to air in the cavity 124 to reduce interference with the conductive elements 144 defining the antenna circuit 142.

In an exemplary embodiment, the lower mounting lugs 450 are offset between the first and second end walls 406, 408. For example, the lower mounting lugs 450 are offset closer to the first end wall 406. The channel 452 is offset between the first end wall 406 and the second end wall 408 to position the substrate 140 closer to the first end wall 406 than the second end wall 408. The lower mounting lugs 450 of the substrate 140 offset from the channel 414 to allow the transmission line 112 to pass straight from the lower strain relief component 412 to the first surface 150 of the substrate 140. For example, the lower mounting lugs 450 are positioned along the bottom wall 400 such that the first surface 150 of the substrate 140 is aligned with an edge 456 of the channel 414. The second surface 152 of the substrate 140 is offset from the channel 414. The transmission line 112 passes straight from the first surface 150 through the lower strain relief component 412.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The patentable scope should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112(f), unless and until such claim limitations expressly use the phrase "means for" followed by a statement of function void of further structure.

What is claimed is:

1. A communication system comprising:

an antenna assembly having an antenna element and a transmission line terminated to the antenna element, the antenna element having a substrate and a dual dipole antenna circuit including a low-band ground terminal, a low-band feed terminal, a high-band ground terminal and a high-band feed terminal, the transmission line having at least one feed line electrically connected to the dual dipole antenna circuit and at least one ground line electrically connected to the dual dipole antenna circuit; and a housing holding the antenna assembly, the housing including an upper shell and a lower shell meeting at an interface, the upper shell having an inner end at the interface and the lower shell having an inner end at the interface, the upper shell including an upper strain relief component at the inner end of the upper shell, the lower shell including a lower strain relief component at the inner end of the lower shell aligned with the upper strain relief to receive the transmission line, the upper shell having an upper locating feature, the lower shell having a lower locating feature, the upper locating feature interfacing with the lower locating feature to locate the upper shell relative to the lower shell.

2. The communication system of claim 1, wherein the upper and lower strain relief components include crush ribs engaging and holding the transmission line in an interference fit.

3. The communication system of claim 1, wherein the upper locating feature comprises a pocket having a first pocket edge and a second pocket edge, the lower locating feature having a tab having a first tab edge and a second tab edge engaging the first pocket edge and the second pocket edge, respectively, wherein at least one of the first pocket edge, the second pocket edge, the first tab edge and the second tab edge have a crush rib.

4. The communication system of claim 1, wherein the upper locating feature comprises a pocket having a first pocket edge and a second pocket edge, the lower locating feature having a tab having a first tab edge and a second tab edge engaging the first pocket edge and the second pocket edge, respectively, wherein the first pocket edge, the second pocket edge, the first tab edge and the second tab edge have curved profiles.

5. The communication system of claim 1, wherein the upper locating feature is one of a plurality of upper locating features located on at least three different walls of the upper shell and the lower locating feature is one of a plurality of lower locating features located on at least three different walls of the lower shell.

6. The communication system of claim 1, wherein the upper shell and the lower shell define a cavity receiving the antenna element, a majority of a first surface of the antenna element and a second surface of the antenna element being exposed to air in the cavity.

7. The communication system of claim 1, wherein the upper shell further comprises an upper latching feature and the lower shell further comprises a lower latching feature interfacing with the upper latching feature to latchably couple the upper shell to the lower shell.

8. The communication system of claim 7, wherein the upper locating feature comprises a ramped latch and the lower locating feature comprises a ramped latch engaging the ramped latch of the upper locating feature.

9. The communication system of claim 1, wherein the upper shell includes a top wall, side walls extending between the top wall and the inner end and end walls extending between the top wall and the inner end, the lower shell having a bottom wall, side walls extending between the bottom wall and the inner end and end walls extending between the bottom wall and the inner end, the upper shell having an upper mounting lug on the top wall engaging and holding a top end of the substrate, the lower shell having a lower mounting lug on the bottom wall engaging and holding a bottom end of the substrate.

10. The communication system of claim 9, wherein the upper strain relief and the lower strain relief define a channel receiving the transmission line, the upper and lower mounting lugs being offset from the upper and lower strain reliefs to align a first surface of the substrate with the channel and to offset a second surface of the substrate, opposite the first surface, from the channel.

11. The communication system of claim 9, wherein the upper mounting lug is a first upper mounting lug engaging a first side of the substrate, the upper shell further comprising a second upper mounting lug engaging a second side of the substrate, the lower mounting lug being a first lower mounting lug engaging the first side of the substrate, the lower shell further comprising a second lower mounting lug engaging the second side of the substrate.

12. The communication system of claim 1, wherein the upper locating feature comprises a pocket having a first pocket edge and a second pocket edge, the lower locating feature having a tab having a first tab edge and a second tab edge engaging the first pocket edge and the second pocket edge, respectively, wherein the first pocket edge and the second pocket edge are concave, and wherein the first tab edge and the second tab edge are convex.

13. The communication system of claim 1, wherein the upper locating feature is a first upper locating feature and the lower locating feature is a first lower locating feature, the upper shell further comprising a second upper locating feature and the lower shell further comprises a second lower locating feature, the first and second upper locating features being oriented perpendicular to each other, the first and second lower locating features being oriented perpendicular to each other.

14. The communication system of claim 1, wherein the antenna element is oriented vertically and the housing engages a top wall of the upper shell and a bottom wall of the lower shell, the transmission line being approximately centered between the top wall and the bottom wall.

15. The communication system of claim 1, wherein the substrate includes a top end and a bottom end, a first side and a second side between the top end and the bottom end, and a first surface and a second surface between the top end and the bottom end, the dual dipole antenna circuit being provided at least on the first surface, the transmission line being terminated to the antenna element at the first surface, the low band feed terminal and the high band feed terminal being located in an upper portion of the substrate between the transmission line and the top end, the low band ground terminal and the high band ground terminal being located in a lower portion of the substrate between the transmission line and the bottom end.

16. The communication system of claim 15, wherein the low band feed terminal is located proximate to the first side and the high band feed terminal is located proximate to the second side, the low band feed terminal being shorter and wider compared to the high band feed terminal, the high band feed terminal being longer and narrower compared to the low band feed terminal, and wherein the low band ground terminal is located proximate to the first side and the high band ground terminal is located proximate to the second side, the low band ground terminal being shorter and wider compared to the high band ground terminal, the high band ground terminal being longer and narrower compared to the low band ground terminal.

17. The communication system of claim 1, wherein the high band feed terminal is tuned to resonate at a first Wi-Fi frequency band approximately twice a second Wi-Fi frequency band at which the low band feed terminal is tuned to resonate.

18. The communication system of claim 1, wherein the high band feed terminal is tuned to resonate at approximately 5 GHz and the low band feed terminal is tuned to resonate at approximately 2.4 GHz.

19. A communication system comprising:

an antenna assembly having an antenna element and a transmission line, the antenna element having a substrate and a dual dipole antenna circuit electrically coupled to the transmission line, the substrate extending between a top end and a bottom end, the substrate having a first side and a second side between the top end and the bottom end, the substrate having a first surface and a second surface, the dual dipole antenna circuit being provided at least on the first surface, the transmission line terminated to the antenna element at the first surface; and a housing having a cavity receiving the antenna assembly, the housing including an upper shell having a top wall and a lower shell having a bottom wall, the upper shell having side walls and end walls extending between the top wall and an inner end opposite the top wall, the lower shell having side walls and end walls extending between the bottom wall and an inner end opposite the bottom wall, the inner end of the upper shell meeting the inner end of the lower shell at an interface, the upper shell including an upper strain relief component on the first side at the inner end, the lower shell including a lower strain relief component on the first side at the inner end aligned with the upper strain relief to define a channel receiving the transmission line, the upper shell having an upper mounting lug on the top wall engaging and holding the top end of the substrate, the lower shell having a lower mounting lug on the bottom wall engaging and holding the bottom end of the substrate, the upper and lower mounting lugs being offset from the upper and lower strain reliefs to align the first surface with the channel.

20. A communication system comprising:

an antenna assembly having an antenna element and a transmission line, the antenna element having a substrate and a dual dipole antenna circuit electrically coupled to the transmission line, the substrate extending between a top end and a bottom end, the substrate having a first side and a second side between the top end and the bottom end, the substrate having a first surface and a second surface, the dual dipole antenna circuit being provided at least on the first surface, the dual dipole antenna including a low-band ground terminal, a low-band feed terminal, a high-band ground terminal and a high-band feed terminal, the low-band feed terminal being asymmetric with respect to the low-band ground terminal, the high-band feed terminal being asymmetric with respect to the high-band ground terminal, the transmission line having at least one feed line electrically connected to the dual dipole antenna circuit at the first surface and at least one ground line electrically connected to the dual dipole antenna circuit at the first surface; and a housing holding the antenna assembly, the housing including an upper shell and a lower shell meeting at an interface, the upper shell having an inner end at the interface and the lower shell having an inner end at the interface, the upper shell including an upper strain relief component at the inner end of the upper shell, the lower shell including a lower strain relief component at the inner end of the lower shell aligned with the upper strain relief to define a channel receiving the transmission line;

wherein the transmission line is routed between the substrate and the channel such that the transmission line interior of the housing is positioned generally equidistant from the low-band feed terminal and the low-band ground terminal and is generally equidistant from the high-band feed terminal and the high-band ground terminal, the transmission line being routed exterior of the housing such that the transmission line exterior of the housing is positioned closer to the low-band ground terminal than the low-band feed terminal and such that the transmission line is positioned closer to the high-band ground terminal than the high-band feed terminal.

* * * * *